US006798354B2

(12) United States Patent
Schuessler

(10) Patent No.: US 6,798,354 B2
(45) Date of Patent: Sep. 28, 2004

(54) DEVICE FOR WARNING THE DRIVER OF A MOTOR VEHICLE OF DANGERS BY RADIO

(75) Inventor: Robert Schuessler, Stuttgart (DE)

(73) Assignee: DaimlerChrysler AG, Stuttgart (DE)

( * ) Notice: Subject to any disclaimer, the term of this patent is extended or adjusted under 35 U.S.C. 154(b) by 0 days.

(21) Appl. No.: 10/203,932

(22) PCT Filed: Dec. 20, 2000

(86) PCT No.: PCT/EP00/12998

§ 371 (c)(1),
(2), (4) Date: Nov. 18, 2002

(87) PCT Pub. No.: WO01/61668

PCT Pub. Date: Aug. 23, 2001

(65) Prior Publication Data

US 2003/0090392 A1 May 15, 2003

(30) Foreign Application Priority Data

Feb. 18, 2000 (DE) ..... 100 07 573

(51) Int. Cl.[7] ..... G08G 1/00

(52) U.S. Cl. ..... 340/901; 340/902; 340/903; 340/995.13; 340/995.27; 340/995.28; 340/471; 701/301

(58) Field of Search ..... 340/901, 902, 340/903, 995.13, 995.27, 995.28, 471, 435, 436; 701/301

(56) References Cited

U.S. PATENT DOCUMENTS

| | | | | |
|---|---|---|---|---|
| 3,784,970 A | | 1/1974 | Simpkin | 340/33 |
| 4,706,086 A | | 11/1987 | Panizza | 340/902 |
| 5,546,311 A | | 8/1996 | Sekine | 365/449 |
| 5,754,099 A | | 5/1998 | Nishimura et al. | 340/435 |
| 6,067,031 A | * | 5/2000 | Janky et al. | 340/903 |
| 6,275,773 B1 | * | 8/2001 | Lemelson et al. | 701/301 |

FOREIGN PATENT DOCUMENTS

| | | |
|---|---|---|
| DE | 40 04 816 A1 | 2/1990 |
| DE | 42 03 930 A1 | 2/1992 |
| DE | 44 21 960 C2 | 6/1994 |
| DE | 197 58 155 A1 | 12/1997 |
| DE | 198 03 345 A1 | 1/1998 |
| DE | 198 22 914 A1 | 5/1998 |
| EP | 0 136 691 | 10/1984 |
| EP | 0 927 983 A2 | 11/1998 |

OTHER PUBLICATIONS

TELE AID—ein Rettungssystem als Symbiose aus Kfz–Electronik, Mobilfunknetz und Satellitenkommunikation, Mercedes–Benz AG, Stuttgart, Telekom praxis—10/97, pps. 43–45.
German Search Report.
PCT International Search Report and translation of relevant portions thereof.

* cited by examiner

*Primary Examiner*—Daniel J. Wu
*Assistant Examiner*—Samuel J. Walk
(74) *Attorney, Agent, or Firm*—Crowell & Moring LLP

(57) ABSTRACT

A device for the radio-transmission of a hazard warning to the driver of a motor vehicle includes a data transmission device for transmitting and receiving data. The data transmission device exchanges data with data transmission devices of other motor vehicles, including data to warn other motor vehicles of the hazard, evaluates received data and outputs warning signals to the driver when a hazard is detected. The transmitted data includes information on the position, speed and direction of travel of the transmitting motor vehicle, as well as the type of road on which the transmitting motor vehicle is moving. The information on the position, the type of road and the direction of travel is generated by a navigation system. A warning zone around the current position of the transmitting vehicle is calculated by a computer unit and emitted by means of the data transmission device.

5 Claims, 3 Drawing Sheets

DEVICE FOR WARNING THE DRIVER OF A MOTOR VEHICLE OF DANGERS BY RADIO

BACKGROUND AND SUMMARY OF THE INVENTION

This application claims the priority of German priority document 100 07 573.8, filed 18 Feb. 2000 18.02.2000) (PCT International Application No. PCT/EP00/12998, filed 20 Dec. 2000 (20.12.2000)), the disclosure of which is expressly incorporated by reference herein.

The invention relates to a device for radio-transmission of a hazard warning to the driver of a motor vehicle.

In road traffic, particularly on highways, poor visibility conditions (for example, at night, in fog or during heavy precipitation), severe accidents and mass pile-ups can occur as a result of rear-end collisions with slowly moving or stationary motor vehicles. Conventional visual hazard warning devices (hazard warning system), however, are inadequate when visibility is poor, and known radio warning systems are not yet sufficiently selective.

German patent document DE 197 58 155 A1 describes a device for radio-transmission of a hazard warning, for motor vehicles that are equipped with a data transmission device for exchanging data for this purpose. When the data transmission device is activated, data for issuing a hazard warning to other motor vehicles is transmitted (including, for example, information on the position, speed and direction of travel of the transmitting motor vehicle, as well as the type of road on which the transmitting motor vehicle is moving.) The data received in the other motor vehicles is then evaluated to determine whether or not it poses a hazard. If so, this danger is communicated to the driver of the motor vehicle by means of warning signals.

U.S. Pat. No. 3,784,970 describes a device for issuing a hazard warning in which a warning is issued only in a warning zone around the transmitting vehicle. The warning zone is generated by using the different propagation speeds of ultrasonic signals and radio signals. When used in a train which warns of its approach, the speed of the train is included in the calculation of the warning zone.

U.S. Pat. No. 4,706,086, on the other hand, describes a device for issuing a hazard warning containing traffic and weather data detected by the vehicle, as well as the time when the event triggering the warning occurred and the distance covered by the vehicle since the occurrence of the event.

One object of the present invention is to provide a warning device of the generic type described above that is more selective than known devices.

Another object of the invention is to alert the driver, as far as possible, only to those sources of hazards which relate to him.

These and other objects and advantages are achieved by the warning system according to the invention, in which information on the position, the type of road and the direction of travel which relate to the transmitting motor vehicle are generated using a navigation system. In addition, a warning zone around the current position of the transmitting motor vehicle is calculated by means of a computer device, and data concerning the warning zone are also emitted with the data transmission device.

This technique has the advantage that the motor vehicle which receives the data can determine better and more quickly whether or not it is affected by a reported source of a hazard. The transmitting (warning) vehicle thus generates a fixed (relative to the moving vehicle) warning trail on the relevant section of the route behind it, in a way which is analogous to a warning triangle which is moving along and can be recognized in good time. Selectivity is achieved by the use of the position information (coordinates with type of road and direction of travel) of the navigation system and by the limitation of the relevance of the information to a fixed warning zone. The relevance of the information is evaluated in turn by a computer unit of the receiving (warned) motor vehicle, using the digital maps of the navigation system. If motor vehicles which are equipped with the device move within the warning trail, they can increase the range of the original hazard warning by actuating their hazard warning lights or their data transmission device, and also extend the warning to motor vehicles which are not equipped with the device.

In one embodiment of the invention, the warning zone is not statically fixed, but rather is determined by different input variables. The warning zone constitutes a preferably circular region about the transmitting motor vehicle. The center point of the warning zone is the current position (coordinates) of the transmitting vehicle, and the extent of the warning zone is described by means of the warning radius R. The warning radius R is determined essentially by the desired minimum warning time $T_{min}$ for other motor vehicles, which should be approximately 5 seconds so that the warned driver can still react in good time.

In addition, the warning radius R is also dependent on system-related position errors $P_{err}$ in the determination of the current vehicle position, and delays $T_{del}$ which are to be assumed in the reporting transmission process and processing operation. Furthermore, the warning radius R is dependent on the approach speed $V_a$ of the motor vehicles and the speed V of the transmitting vehicle itself. Typical maximum speeds for the type of road on which the transmitting motor vehicle is moving are used as the approach speed $V_a$ of the other motor vehicles in order to calculate the warning radius.

The following formula is obtained for the calculation of the warning radius:

$$R=(T_{min}+T_{del})*(V_a-V)+P_{err}$$

The activation of the data transmission device is carried out by the driver by means of a manual activation of a switch. The hazard warning is generated and transmitted automatically only if an accident is detected by internal sensors (crash sensors). In one advantageous embodiment, the activation of the data transmission device is linked to the manual activation of the switch of the hazard warning lights.

As all motor vehicles are not equipped with such a device in conjunction with a navigation system, a motor vehicle which is equipped with such a device can perform the hazard warning on behalf of another vehicle which poses a hazard. Thus, there are therefore basically two cases to distinguish.

In the first case, the transmitting motor vehicle itself is the source of the hazard and the current position of the motor vehicle marks the location the hazard. The hazard warning is then transmitted until the problem is solved and the source of the hazard is eliminated and the device for issuing hazard warnings is deactivated.

In the second case, the driver of the motor vehicle detects a hazard (other road user) which does not have a device for transmitting a hazard warning or which has not transmitted a hazard warning. In this case, additional information is transmitted, from which the motor vehicles which receive the hazard report can infer that the transmitting vehicle itself is not the source of the hazard. This additional information can be generated, for example, by virtue of the fact that when the driver detects and/or passes by a source of a hazard he activates the switch to actuate the data transmission device. If the actuation function is linked to the switch of the hazard warning system, the computer unit of the device checks, by evaluating the internal sensors, whether there is a reason (for example an accident, a strong braking operation or a breakdown) for the triggering of the hazard warning system, such that the transmitting motor vehicle itself constitutes the source of a hazard. If the computer unit determines that there is no reason for triggering the hazard warning lights, the transmitted data is supplemented by information indicating that the motor vehicle is issuing the hazard warning on behalf of another road user. The motor vehicle which is transmitting on behalf of another automatically transmits the hazard warning at regular intervals without changing the current position of the source of the hazard until said vehicle itself has left the calculated warning zone.

The transmission of such additional information is important; without it the computer unit of the motor vehicles which receive the hazard warning might conclude from the absence of the hazard warning when the transmitting motor vehicle deactivates the data transmission device again that the source of the hazard no longer exists. In this case, the hazard warning is stored and displayed to the driver until the location of the source of the hazard has been passed. Whether the received hazard warning is transmitted on is the decision of the driver whose data transmission device has received the hazard report.

Other objects, advantages and novel features of the present invention will become apparent from the following detailed description of the invention when considered in conjunction with the accompanying drawings.

DETAILED DESCRIPTION OF THE INVENTION

Figure 1:
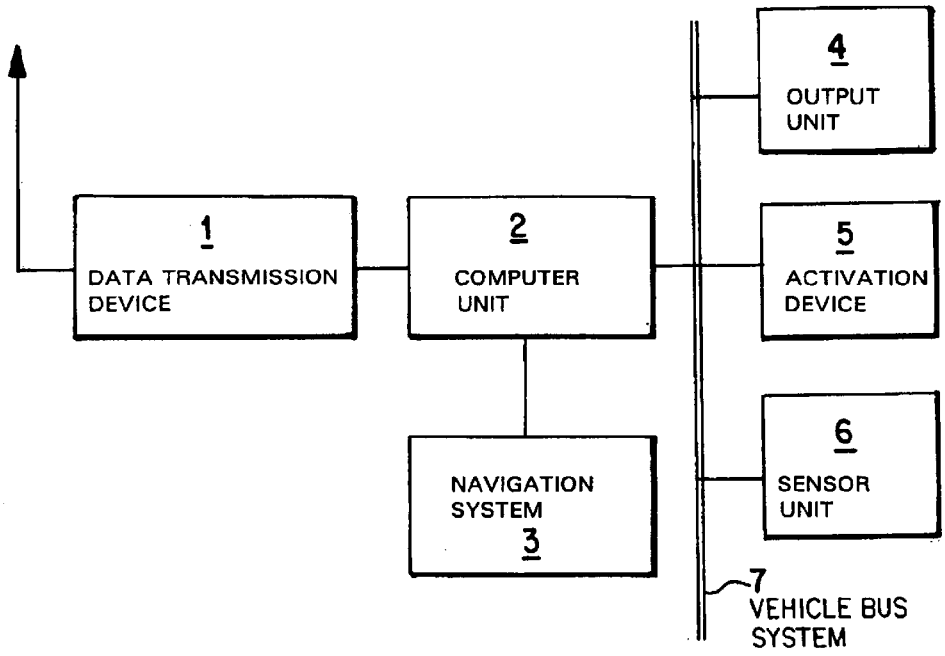
FIG. 1 shows a block diagram of a device for the radio-transmission of a hazard warning.

As is shown in FIG. 1, the device for the radio-transmission of a hazard warning comprises a data transmission device 1, a computer unit 2, a navigation system 3, an output unit 4, an activation device 5 and a sensor unit 6 which are preferably connected via a vehicle bus system 7.

Figure 2:
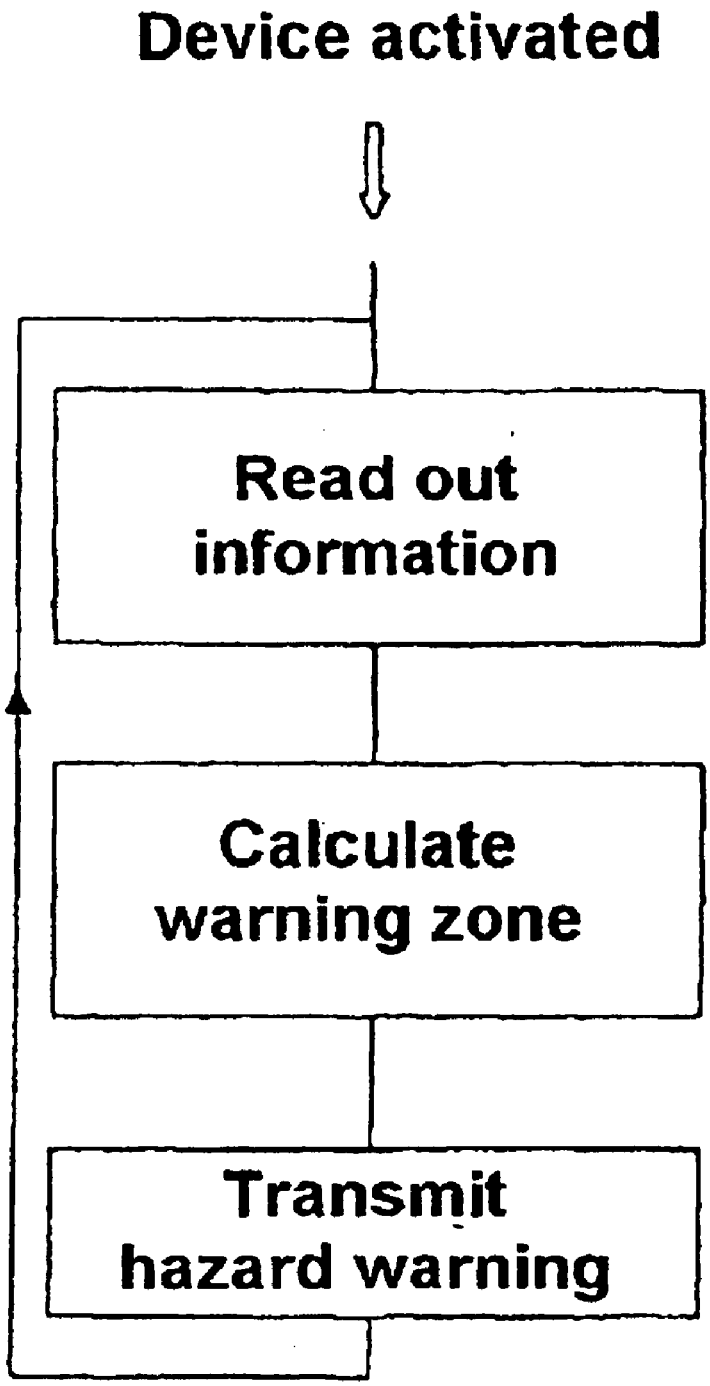
FIG. 2 shows a flowchart for generating the hazard warning in the transmitting motor vehicle.

The hazard warning is generated according to the flowchart in FIG. 2. After actuation of the system by the actuation device 5, the computer unit 2 reads out from the navigation system 3 the coordinates of the current position, the type of road on which the motor vehicle is moving and the direction of travel. In addition, the current vehicle speed V is read out of the sensor unit 6. Then, the warning radius R of the warning zone is calculated by the computer unit 2 according to the formula $$R=(T_{min}+T_{del})*(V_a-V)+P_{err}$$

Then, the hazard warning (with information relating to the current position, the type of road being traveled the current vehicle speed V and the calculated warning radius R) is transferred to the data transmission device 1 and is transmitted at regular intervals. The transmission of the hazard warning is ended either by deactivation of the device, or by its leaving the calculated zone if the transmission is on behalf of another road user. The operating frequency of the device for issuing a hazard warning is selected such that it can be transmitted with the antenna systems in the vehicle and lies in a frequency band which is available for that purpose. Thus, for example the 87.5 MHz EUROSIGNAL or the ISM band in the range 800–900 MHz can be used. As the warning is to be selective, a range of the transmission signal of approximately 3 km is sufficient.

Figure 3:
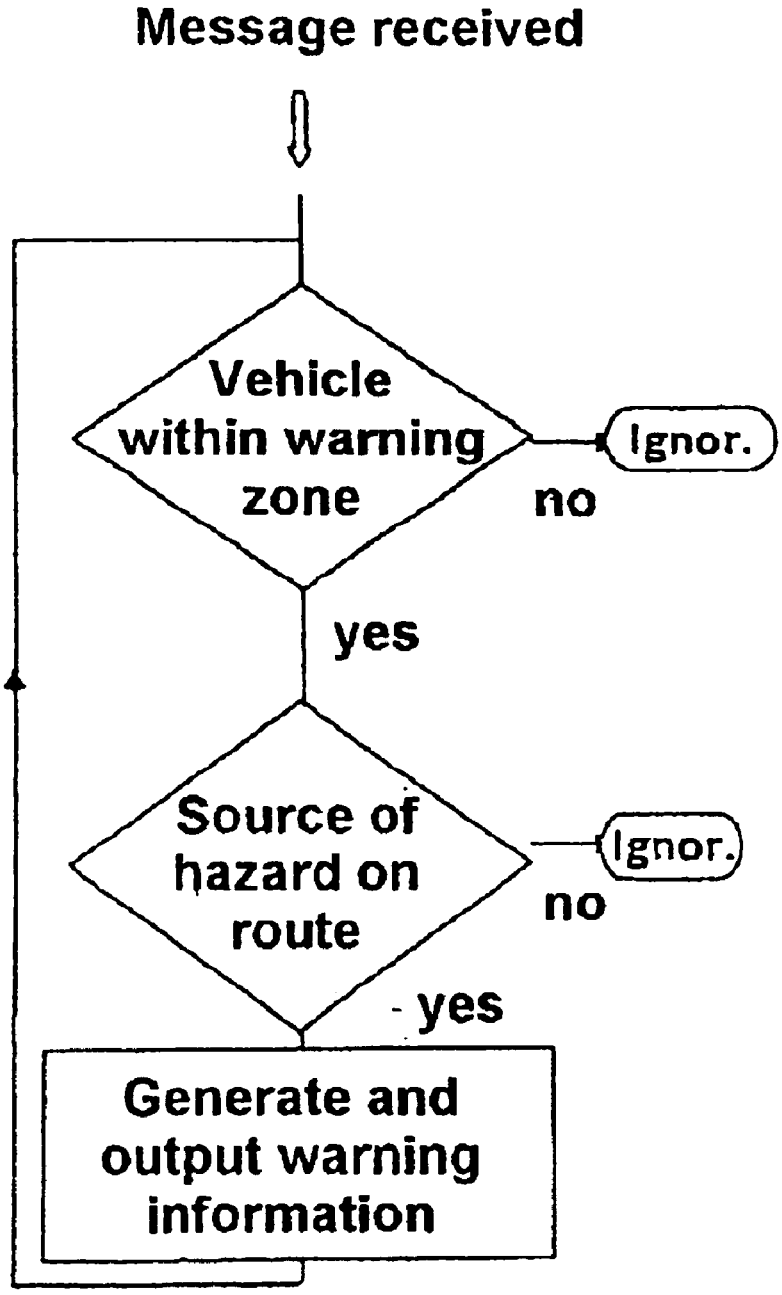
FIG. 3 shows a flowchart for evaluating the hazard warning in the receiving motor vehicle.

The hazard warning is evaluated in the receiving vehicle according to the flowchart in FIG. 3. After reception of the hazard warning by the data transmission device 1, the computer unit 2 checks, using the position data of the navigation system 3, whether the motor vehicle is located within the warning zone. If the motor vehicle is outside the warning zone, the hazard warning is ignored. If the motor vehicle is within the warning zone, the computer unit 2 checks, using the digital map of the navigation system 3, the theoretically possible route sections ahead (electronic horizon) for a distance which corresponds to the warning radius of the warning zone. With reference to the position contained in the hazard warning, the road and direction of travel, it is then checked whether the location of the hazard (of the transmitting motor vehicle) can be assigned to one of the possible route sections ahead. If not, the report is ignored, but otherwise a suitable warning information item for the driver is generated, for example by representing the position of the source of the hazard in a flashing manner on the route represented with the output unit 4. After the hazard warning has been displayed, it is up to the driver whether or not he actuates his hazard warning system and/or also emits a hazard warning.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

What is claimed is:

1. Apparatus for radio-transmission of a warning to a driver of a motor vehicle, said apparatus comprising a data transmission device for transmitting and receiving data to and from data transmission devices of other motor vehicles, including data to warn other motor vehicles of a hazard, said data comprising information on position, speed and direction of travel of the transmitting motor vehicle and type of road on which the transmitting motor vehicle is moving, and said apparatus further comprising means for evaluating received data and outputting warning signals to the driver when a hazard is detected; wherein:

the information concerning the position, type of road and direction of travel is generated by a navigation system;

a warning zone around a current position of the transmitting vehicle is calculated by a computer unit and transmitted by the data transmission device; and the warning zone, in the form of a radius around the position of the transmitting vehicle, is calculated as a function of a minimum pre-warning time, a system-dependent delay, a current speed of the transmitting motor vehicle, an approaching speed and a system-dependent position error.

2. The apparatus according to claim 1, wherein the computer unit of a receiving motor vehicle checks the relevance of a received hazard warning, using digital maps of the navigation system.

3. The apparatus according to claim 1, wherein the data transmission device is activated by the driver by means of a manual switch, or automatically by means of a computer unit as a function of evaluation of internal sensor data.

4. The apparatus according to claim 1, wherein the transmitted data includes information on whether the transmitting vehicle itself constitutes the source of the hazard or the transmitting vehicle is emitting the hazard warning on behalf of another road user.

5. The apparatus according to claim 1, wherein position of the source of the hazard is represented on an output unit of the navigation system.

* * * * *